United States Patent [19]

Patterson, III et al.

[11] 4,100,875

[45] Jul. 18, 1978

[54] CONNECTORS

[76] Inventors: William W. Patterson, III; Eugene F. Grapes, both of c/o W. W. Patterson Co., 830 Brocket St., Pittsburgh, Pa. 15233

[21] Appl. No.: 782,049

[22] Filed: Mar. 28, 1977

[51] Int. Cl.[2] ..... B63B 21/00

[52] U.S. Cl. ..... 114/251; 254/67; 403/44

[58] Field of Search ..... 403/44, 45, 43, 46, 403/183, 184, 180; 254/67, 100; 114/251, 249, 253

[56] References Cited

U.S. PATENT DOCUMENTS

| | | | |
|---|---|---|---|
| 1,231,067 | 6/1917 | Sansom | 114/251 |
| 1,854,055 | 4/1932 | Montgomery | 254/100 |
| 2,360,019 | 10/1944 | Ryan et al. | 403/44 |
| 2,818,229 | 12/1957 | Guthans | 114/251 X |
| 3,292,567 | 12/1966 | Blackburn | 114/251 |
| 3,683,839 | 8/1972 | Harbisch | 114/249 |
| 3,785,324 | 1/1974 | Guthans | 254/67 X |

*Primary Examiner*—Andrew V. Kundrat
*Attorney, Agent, or Firm*—Buell, Blenko & Ziesenheim

[57] ABSTRACT

A connector for barges and the like is provided in the form of a threaded ratchet tube, a central ratchet drive for rotating said tube, an annular drive wheel surrounding and connected to said tube for rotating the same, separate right and left hand threaded screw members having one end threaded into said tube, fastening means on the other end of each said screw members and removable anchor means adapted to engage a surface over which the ratchet tube extends engaging one of said fastening means and holding said tube above said surface a distance greater than the radius of said annular drive wheel.

6 Claims, 6 Drawing Figures

CONNECTORS

This invention relates to connectors and particularly to a variable length connecting and typing device. The invention has particular applicability to barge and vessel connectors such as are used, for example, in connecting barges when fleeted together into a tow for moving from one place to another.

The time honored practice in fleeting together a tow of barges was to fasten the barges together with a cable and then to tighten the cable ends together by means of a type of portable turnbuckle commonly known as a "ratchet". This practice was dangerous since the ratchets when subjected to undue strain would break, releasing the cable and at times injuring the barge tenders or seamen who happen to be working in the area. The practice was, moreover, time consuming and expensive because of losses and high maintenance and repair on the movable type of ratchet. The ratchets heretofore used are, moreover, awkward to readjust and frequently a sufficient strain on the cable is difficult, if not impossible, to obtain without several readjustments. The portable ratchet is inherently dangerous because the parts tend to fly in all directions at high velocities if they break under strain. It is also dangerous to release the conventional type of portable ratchet when there is strain on the rigging such as happens in emergencies. The ratchet being a loose piece of equipment, is easily lost overboard and damaged by careless handling.

This problem was recognized by Guthens U.S. Pat. No. 2,818,229 issued Dec. 31, 1957 and a connecting and tying device was there proposed. That tying device was and is a highly successful solution to many of the problems which characterized the barge art, however, it was expensive and time consuming to use because it requires adjustment of its position on the deck in order to obtain maximum usefulness. It was slow in operation because of the relatively slow rotation which could be produced in the tightening means. Slow rotation of the barrel in ratchet operated turnbuckle devices is characteristic of such devices.

The present invention overcomes all of the problems of all of the tying devices known to us for use on barges and like surfaces. The present invention reduces the time needed to fleet a given group of barges by as much as 80%. Moreover, it can be used in place of a standard winch at about 25% of the cost of a winch.

In a preferred embodiment of our invention, we provide a threaded ratchet tube having a central ratchet drive for rotating the tube and left hand threads at one end and right hand threads at the other, an annular drive wheel surrounding and spaced from the tube intermediate one end and the central ratchet for rotating said tube separate right and left hand threaded tightening means one threaded at each end of the tube, fastening means on the other end of each tightening means, and removable anchor mans adapted to engage a surface over which the ratchet tube extends engaging one of said fastening means and holding the ratchet tube above said surface a distance greater than the radius of the drive wheel. Preferably the drive wheel is fixed to the ratchet tube adjacent one end for rapid rotation of the tube to take up slack. The tightening means are preferably elongated threaded bolts in which the fastening means on the said other end is a forged eye. The anchoring means is preferably a pair of spaced triangular members having a base portion adapted to at least partially engage a deck or other surface over which the connector operates, a shaft spaced from the base to engage one of said fastening means and means attaching the anchor means to the deck or other surface.

In the foregoing general description of our invention, we have set out certain objects, purposes and advantages of the invention. Other objects purposes and advantages of the invention will, however, be apparent from a consideration of the following description and the accompanying drawings in which.

Figure 1:
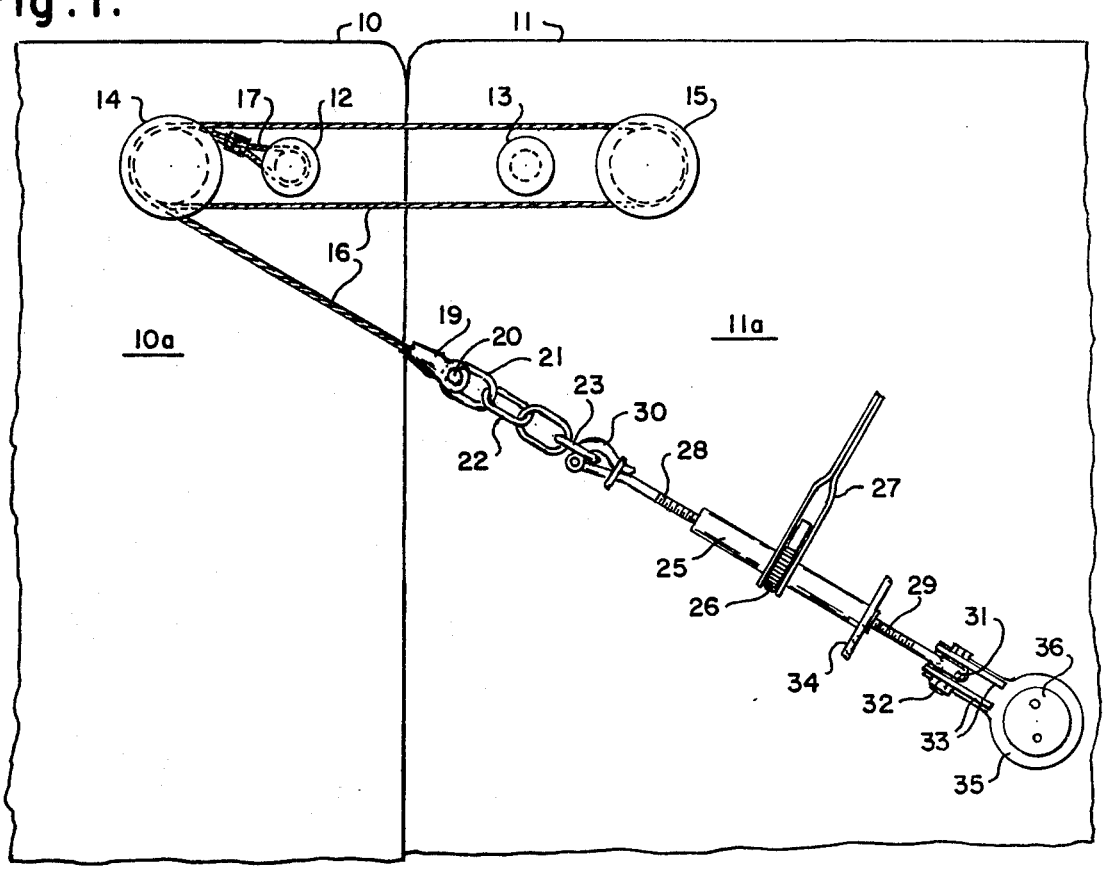
FIG. 1 is a top plan view of a pair of side by side barges with the connector of this invention in place.

Referring to the drawings, we have illustrated a pair of side by side barges 10 and 11 with decks 10*a* and 11*a* provided with cable fittings 12, 13, 14 and 15 around which a connector cable 16 is passed with cable end loop 17 over fitting 12. The other cable end 18 is provided with a clevis 19 carrying pin 20 passing through chain link 21 of chain 22. A ratchet tube or barrel 25 having a ratchet drive gear 26 intermediate its ends and an actuator ratchet handle 27 by means of which the drive gear 26 and barrel 25 may be rotated. Right 28 and left 29 threaded screw members are threaded into barrel 25 at its opposite ends. Screw member 28 is provided at its free end with a pelican hook 30 which passes through chain link 23 of chain 22. The other screw member 29 is provided at its free end with eye 31 through which bolt 32 passes between triangular anchor members 33. The triangular members 33 and bolt 32 are arranged to space screw member 29 sufficiently above the deck 11*a* that annular hand drive wheel 34 on the end of barrel 25 clears the deck 11*a*. The slack in cable 16 is rapidly taken up by rotating hand wheel 34 to rotate barrel 25 causing screw members 28 and 29 to enter barrel 25. Final tightening of cable 16 is accomplished with ratchet handle 27 and drive gear 26. The anchor members 33 are fixed to eye 35 which is in turn rotatable on post 36 on deck 11*a*.

Figure 3:
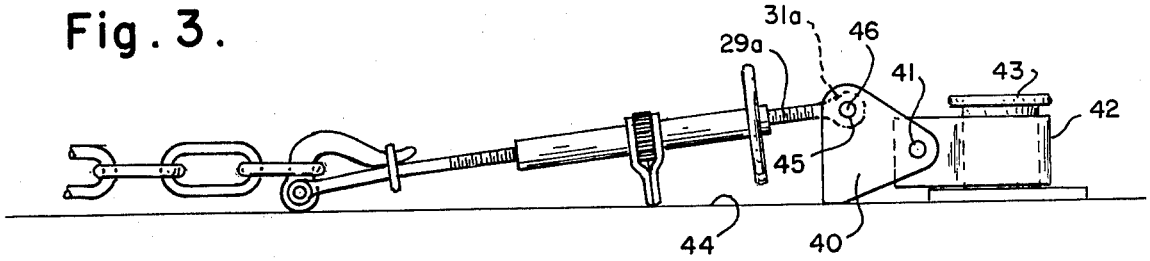
FIG. 3 is a side elevation of a second form of anchor member used in this invention.

In FIG. 3 we have illustrated another form of anchor arrangement in which two triangular members 40 having a bolt 41 passing through one corner of the members 40 and through collar 42 passing around post 43 on deck 44. Openings 45 in the top corner carry pin 46 for engagement in eye 31*a* of threaded member 29*a*.

Figure 4:
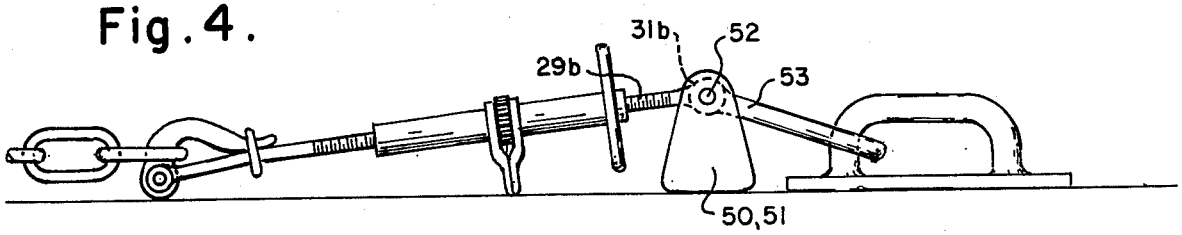
FIG. 4 is a side elevation of a third form of anchor member used in this invention.

In FIG. 4 we have still another form of anchor member in which two triangular members 50 and 51 are fixed on pin 52 which passes through the eyes of clevis 53 and eye 31*b* of threaded screw member 29*b*.

Figure 5:
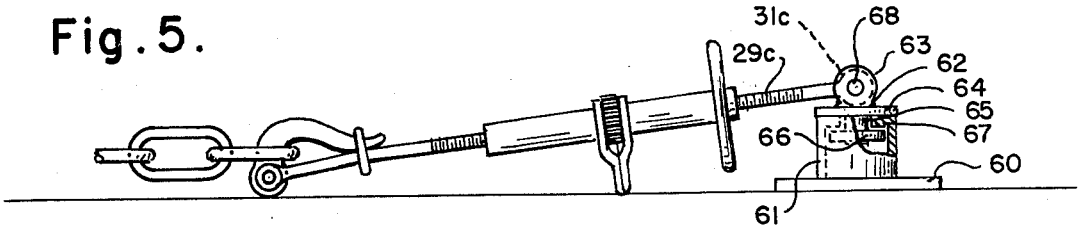
FIG. 5 is a side elevational view of a fourth form of anchor member partly in section used in the invention.

In FIG. 5, we have illustrated another form of anchor means consisting of a base 60 having a vertical post 61 carrying a swivel head 62 made up of a pair of spaced clevis eyes 63 fixed on base plate 64 which rests on top of post 61. Base plate 64 is connected by pin 65 to a locking plate 66 below radial inner flange 67 in the interior of post 61. A bolt 68 passes through clevis eyes 63 and the eye 31*c* of threaded screw member 29*c*. The base 60 is welded to the deck of a vessel to hold it in position.

Figure 2:
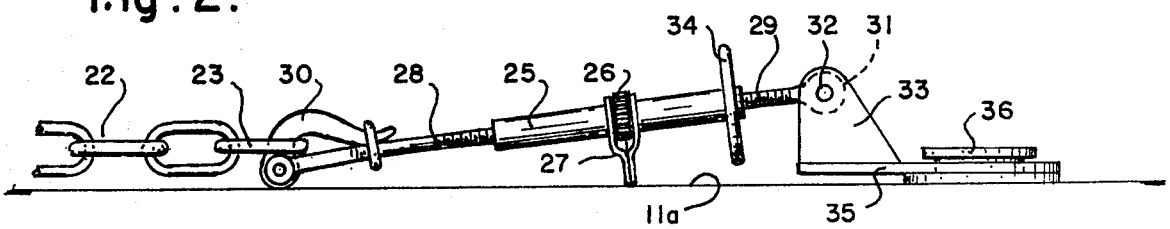
FIG. 2 is a side elevation of the connector of this invention with one form of anchor.
Figure 6:
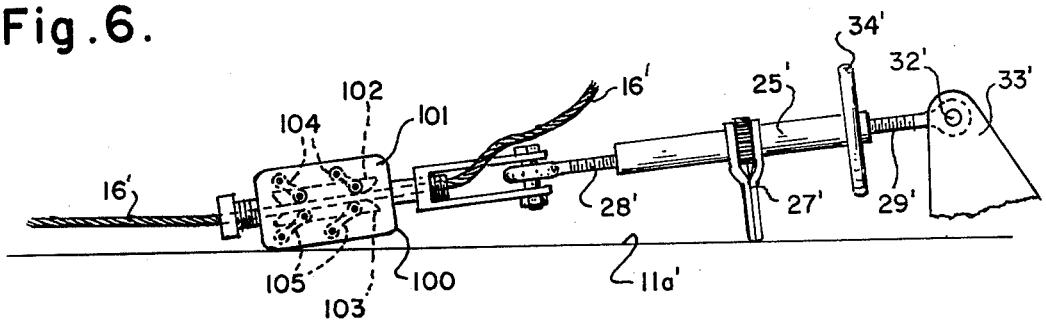
FIG. 6 is a side elevational view of another embodiment of this invention.

In FIG. 6, we have illustrated a connector which is similar to that of FIGS. 1 and 2 and bearing like members with a prime suffix on like parts. The only difference between the apparatus of FIG. 6 and that of FIGS. 1 and 2 is in the substitution of wire rope clamp 100, for pelican hook 30 of FIGS. 1 and 2 and the elimination of the chain 22 from cable 16 so that cable 16 passes through clamp 100. The clamp 100 is of the type which grips the cable when the cable is under tension or load in one direction but permits it to move freely through the clamp or tensioning or loading in the other direction. Clamp 100 includes a housing 101 in which is mounted two parallel elongated grip members 102 and 103, one on each side of cable 16. The grip members 102 and 103 are pivotally mounted between two pairs of spaced parallel carrier arms 104 and 105 which are in turn pivoted at one end in housing 101 so that movement in one direction causes the grip members 102 and 103 to move toward one another and grip the cable between them and movement in the opposite direction causes the grip members 102 and 103 to separate and release the cable.

In operation the apparatus of FIG. 6 is installed on the deck as in the case of FIGS. 1 and 2, the cable 16 is passed through grip clamp 100 and manually pulled as tight as possible. When the pull on cable 16 is released, the grip members 102 and 103 will hold it and the cable is then finally tightened using wheel 34 and ratchet handle 27 and gear 26.

While we have illustrated certain presently preferred practices and embodiments of our invention in the foregoing specification, it will be obvious that this invention may be othewise embodied within the scope of the following claims.

We claim:

1. Connector means for barges and the like comprising a threaded ratchet tube, a central ratchet drive for rotating said tube, an annular drive wheel surrounding and connected to said tube for rotating the same, separate right and left hand threaded screw members having one end threaded into said tube, fastening means on the other end of each said screw members and removable anchor means adapted to engage a surface over which the ratchet tube extends and pivotally secured to one of said fastening means on said separate screw members on the end remote from said tube and holding said tube and fastening means at an angle above said surface so as to have said tubes a distance greater than the radius of said annular drive wheel whereby the drive wheel is always free of the surface to facilitate turning by hand.

2. A connector as claimed in claim 1 wherein the other of said fastening means is provided with hook means.

3. Connector means for barges and the like comprising a threaded ratchet tube, a central ratchet drive for rotating said tube, an annular drive wheel surrounding and connected to said tube for rotating the same, separate right and left hand threaded screw members having one end threaded into said tube, fastening means on the other end of each said screw members and removable anchor means adapted to engage a surface over which the ratchet tube extends engaging one of said fastening means and holding said tube above said surface a distance greater than the radius of said annular drive wheel, said anchor means being a pair of spaced triangular members having a base portion adapted to at least partially engage the surface over which the connector operates, and having a shaft opposite the base receiving the fastening means.

4. Connector means for barges and the like comprising a threaded ratchet tube, a central ratchet drive for rotating said tube, an annular drive wheel surrounding and connected to said tube for rotating the same, separate right and left hand threaded screw members having one end threaded into said tube, fastening means on the other end of each said screw members and removable anchor means adapted to engage a surface over which the ratchet tube extends engaging one of said fastening means and holding said tube above said surface a distance greater than the radius of said annular drive wheel, wherein the other of said fastening means includes a friction grip cable clamp engaging a cable when the cable is tensioned in one direction and releasing the cable when said cable is tensioned the opposite direction.

5. Connector means for barges and the like comprising a threaded ratchet tube, a central ratchet drive for rotating said tube, an annular drive wheel surrounding and connected to said tube for rotating the same, separate right and left hand threaded screw members having one end threaded into said tube, fastening means on the other end of each said screw members and removable anchor means adapted to engage a surface over which the ratchet tube extends engaging one of said fastening means and holding said tube above said surface a distance greater than the radius of said annular drive wheel, said anchor means being vertical post and swivel clevis means on said post engaging one of said fastening means.

6. A connector as claimed in claim 5 wherein the vertical post is hollow and the swivel clevis means includes a swivel plate resting on top of said post and provided with clevis means engaging one of said fastening means, a depending pin on said swivel plate coaxially within the post, a locking plate on the end of said depending pin and a radial inner flange in said post between said swivel plate and locking plate, holding them on the post in swivelling arrangement.

* * * * *